United States Patent [19]

Green

[11] Patent Number: 4,584,958

[45] Date of Patent: Apr. 29, 1986

[54] BOAT BUMPER

[76] Inventor: David A. Green, P.O. Box 359, Hawkestone, Ontario, Canada, L0L 1T0

[21] Appl. No.: 468,913

[22] Filed: Feb. 23, 1983

[30] Foreign Application Priority Data

Jan. 12, 1983 [CA] Canada ..... 419298

[51] Int. Cl.[4] ..... B63B 59/02

[52] U.S. Cl. ..... 114/219

[58] Field of Search ..... 14/84, 219, 220, 234; 293/151, 152; 405/70, 71, 211, 212, 215; 114/290 A

[56] References Cited

U.S. PATENT DOCUMENTS

| | | | |
|---|---|---|---|
| 1,280,246 | 10/1918 | Kubeczko | 114/240 A |
| 3,026,548 | 3/1962 | Dollinger | 114/219 |
| 3,183,875 | 5/1965 | Russell | 114/219 |
| 3,211,123 | 10/1965 | Foss | 114/220 |
| 3,246,349 | 4/1966 | Lyon | 114/84 |
| 3,286,680 | 11/1966 | Caretta | 114/219 |
| 3,540,403 | 11/1970 | Russell | 114/219 |
| 3,610,669 | 10/1971 | Morrissey, Sr. | 293/152 |
| 3,782,768 | 1/1974 | Moore | 114/219 |
| 4,074,649 | 2/1978 | Stranahan | 114/219 |
| 4,343,258 | 8/1982 | Belvedere | 114/219 |

FOREIGN PATENT DOCUMENTS

| | | | |
|---|---|---|---|
| 26758 | 4/1981 | European Pat. Off. | 405/70 |
| 110693 | 8/1980 | Japan | 114/219 |

*Primary Examiner*—Sherman D. Basinger
*Assistant Examiner*—Jesûs D. Sotelo
*Attorney, Agent, or Firm*—Mawhinney & Mawhinney & Connors

[57] ABSTRACT

A bumper for protecting the hull of a boat comprising a plurality of one-piece bumper bodies of resilient deformable material positioned end-to-end. Each of these bodies has a curved portion with a periphery forming a partial cylinder extending through an arc exceeding 180 degrees and a socket portion having a semi-cylindrical cavity with a radius equal to the radius of the partial cylinder. Preferably the curved periphery of the partial cylinder extends through 270 degrees so that the bumper can bend around a 90 degree corner of the boat. Each body has a passage extending lengthwise through both the curved portion and the socket portion. A rope passes through all the passages to connect the bodies together and form a complete bumper. The bodies are positioned on the rope with the curved portion positioned in the socket portion of the adjoining bumper body. Preferably a rope cleat is used to fix the bumper bodies against displacement relative to the rope.

2 Claims, 5 Drawing Figures

BOAT BUMPER

This invention relates to resilient bumpers or fenders for the protection of boats, particularly the hulls thereof.

BACKGROUND OF THE INVENTION

Various boat bumpers or fenders are known in the boating industry. These may be solid or hollow and are made from various materials. One form of a simple boat bumper is shown in U.S. Pat. No. 3,183,875 issued May 18, 1965 to L. E. Russell. The bumper consists of a number of hollow units held together by a rope that extends through two holes formed in each unit. Each bumper unit has a generally square cross-section and is rectangular when viewed from the top and from the side. The walls are resilient and formed of a plastic material. Each bumper unit also has an inflating valve by means of which the unit may be pneumatically inflated in a conventional manner. One difficulty with this bumper and other known boat bumpers is that they do not provide adequate protection for the corner of a boat hull such as where the side of the boat meets the boat deck. The known bumpers cannot be bent around corners.

Another marine bumper is that taught by U.S. Pat. No. 3,540,403 issued Nov. 17, 1970 to Linus E. Russell. This known bumper has a unitary construction and is made by a blow molding process. The bumper has two elongate hollow bulbous body segments that extend parallel to one another. These segments are connected together by a web which has a tube extending down the centre thereof to accommodate a line or rope. Although this bumper will bend to some extent because it is made of a resilient flexible material, the bumper could not be bent around sharp corners such as a 90 degree corner.

U.S. Pat. No. 3,286,680 dated Nov. 22, 1966 and issued to Robert Caretta discloses a boat fender made from several elongate, cylindrical bodies of resilient material. Each body has a hemi-spherical top, a cylindrical bore extending most of its length, and an open bottom defined by a rounded bottom edge. The individual units are held together by means of a rope. This rope extends through a passageway formed in the hemispherical top. Because of the shape of adjacent ends, the fender units will swivel to some extent relative to each other. However this known boat fender will still not provide adequate protection for the corner of a boat such as where the hull meets the boat deck. Even if two of the fender units met at such a corner, the adjacent ends of the units would tend to separate and thus leave the corner of the boat exposed.

An object of the present invention is to provide an improved bumper unit for protecting the hull of a boat.

A further object of the present invention is to provide a bumper unit having a partial cylinder at one end and a socket portion at the other end, which unit can be used in conjunction with other similar bumper units to provide a bumper that will bend around curved surfaces.

SUMMARY OF THE INVENTION

According to the present invention, there is provided a bumper unit for protecting the hull of a boat comprising a one-piece non-metallic bumper body of resilient deformable material. The body has a curved portion with a periphery forming a partial cylinder extending through an arc of at least 225 degrees but less than 360 degrees. The body also has a socket portion having a semi-cylindrical cavity with a radius equal to the radius of said partial cylinder. The cavity is located a short distance from the curved portion relative to the length of the unit. Passage means extends lengthwise of said body through the curved portion and the socket portion and is adapted for passage of a rope to connect the unit to a similar bumper unit.

Preferably the passage means has a narrow bore portion extending through the socket portion and partway through the curved portion and a wide slot portion in a section of the curved portion furthest from the socket portion. The bumper body can be hollow or can be filled with a low density polyethylene. In one embodiment the curved periphery forming the partial cylinder extends 180 degrees around the end of the curved portion furthest from the socket portion and a further 90 degrees from one side of the curved portion to a point adjacent the middle of one end of the socket portion. A bumper made from these preferred bumper units can readily bend around a 90 degree corner.

A preferred embodiment of the invention will now be described with reference to the accompanying drawings.

DETAILED DESCRIPTION OF PREFERRED EMBODIMENT

Figure 3:
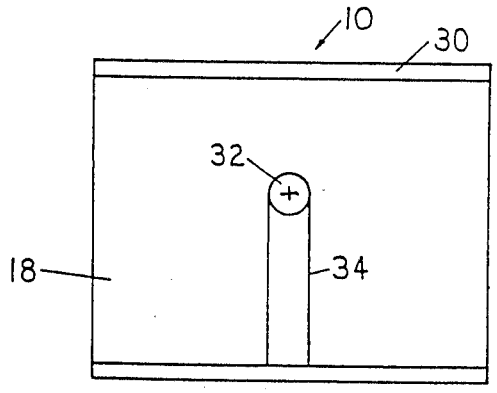
FIG. 3 is a top view of the bumper unit shown in FIG. 1.
Figure 1:
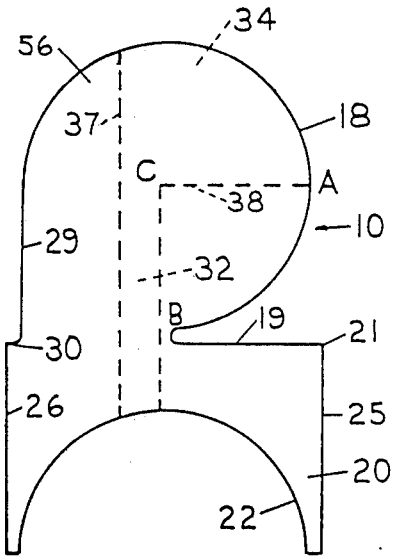
FIG. 1 is a side view of a bumper unit constructed in accordance with the invention.
Figure 2:
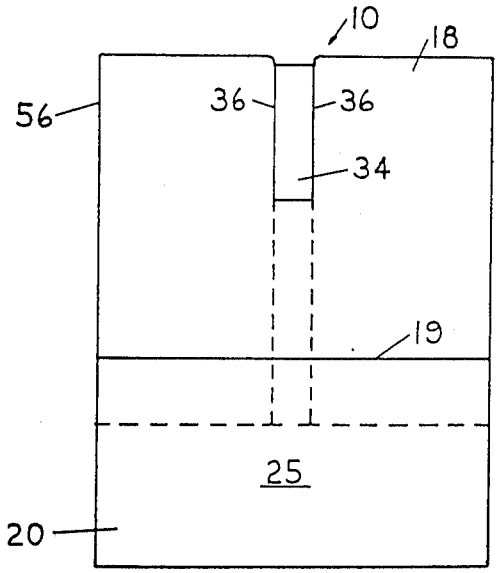
FIG. 2 is a front view of the same bumper unit.
Figure 4:
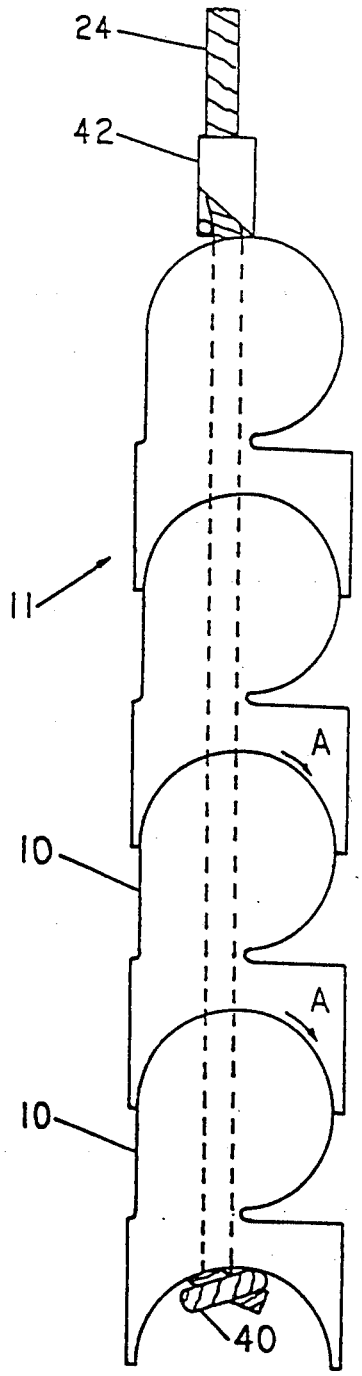
FIG. 4 is a side view of four bumper units arranged end-to-end in a row.

A boat bumper can be constructed by combining a number of bumper units 10, one of which is shown in FIGS. 1 to 3. A bumper 11 made from four of these bumper units 10 is shown in FIG. 4. The individual bumper units comprise a one-piece bumper body of resilient deformable non-metallic material. The bumper unit comprises two main portions that are roughly equal in size. There is a curved portion 18 with a periphery forming a partial cylinder extending through an arc of at least 225 degrees but less than 360 degrees. In the embodiment shown, the curved periphery forming the partial cylinder extends 180 degrees around the end of the curved portion 18 furthest from the second main portion of the bumper unit which comprises a socket portion 20. In addition the curved periphery extends a further 90 degrees from point A located on one side of the curved portion to point B which is adjacent the middle of one end of the socket portion 20. It is preferable for the arc of the partial cylinder to extend 270 degrees in order that the bumper constructed from these units can bend around 90 degree corners. However it will be appreciated that an arc of less than 270 degrees could also be used if the proposed application for the bumper does not require that the bumper be capable of bending around 90 degree corners. For some applications a 45 degree bend between adjacent bumper units will suffice.

The aforementioned socket portion 20 is integrally connected to the curved portion at one end 19. Approximately one-half of the end 19 is a flat surface extending from about the middle of the end 19 to the front edge 21. The socket portion also has parallel, flat front and rear sides 25 and 26. In the end of the socket portion opposite the end 19 is a semi-cylindrical cavity 22 with a radius substantially equal to the radius of the partial cylinder formed by the curved portion 18. The cavity 22 as shown is located a short distance from the curved portion relative to the length of the unit.

As can be seen from FIG. 1, the total width of a socket portion from front side 25 to rear side 26 is slightly greater than the maximum width of the curved portion 18. Because of this, the flat rear side 29 of the curved portion 18 is disposed a short distance inwardly from the plane of the rear side 26. A small shoulder 30 is formed where the side 26 of the socket portion meets the side 29.

Passage means extends lengthwise of the body through the curved portion 18 and the socket portion 20 and is adapted for passage of a rope or similar connecting member to connect the unit to a similar bumper unit. In the illustrated preferred embodiment, the passage means has a narrow bore portion 32 extending through the socket portion and partway through the curved portion 18 and a wide slot portion 34 in a section of the curved portion furthest from the socket portion. As can be seen from FIG. 3, the bore portion 32 preferably has a circular cross-section that is slightly greater in diameter than the rope to be used with the bumper unit. The wide slot portion 34 has a width between its side walls 36 equal to the diameter of the bore portion 32. The wide slot portion 34 in the other direction extends from interior wall 37 that is an extension of one side of the wall forming the bore portion 32 and an interior wall 38 that is perpendicular to the wall 37. As can be seen from FIG. 1, the slot portion 34 opens into the partial cylinder formed on the curved portion 18 across an arc of at least 90 degrees. It will be appreciated that the wide slot portion 34 permits any rope extending through the passage to bend about point C when one bumper unit is rotated relative to the adjoining unit. Thus the connecting rope does not interfere with the bending of the bumper.

Each bumper unit can be of either hollow construction or solid (except for the aforementioned passage means). In either case the exterior layer is made from flexible marine vinyl. If a solid construction is desired, the interior can be filled with a liquid foam which expands and hardens on curing, which foam will permit the bumper unit to have the necessary resiliency. An example of such a foam is a urethane foam.

Preferably each bumper unit is constructed with the use of a blow molding process that uses a two piece mold. A preferred composition for making the bumper units comprises one hundred parts of a resin sold under the trade mark GEON 30 by B.F. Goodrich plus three parts of a stabilizer comprising barium-cadmium also sold by B.F. Goodrich. The stabilizer provides a finished product with a desirable degree of flexibility and elasticity. In addition to these ingredients, a fungicide is used because of the wet conditions to which the bumper unit will be subjected. A suitable fungicide is Bentron. If used in the concentrate form sold under the trade name SBI, only $\frac{1}{4}$ to $\frac{1}{2}$ part is required. If a solid form of Bentron is used, 2 to 3 parts should be added to the mixture. A plasticizer should also be used in the composition. A suitable amount is 55 parts of the plasticizer, which can be that sold under the trade name DLP. Finally 10 to 15 parts of titanium dioxide should be added to the composition to make the finished vinyl opaque and to prevent discoloration and deterioration. The exterior vinyl layer forming the bumper unit is between $\frac{1}{8}$ inch and $\frac{3}{8}$ inch thick.

The present bumper units could also be produced by an injection molding process using well known techniques. However injection molding of these units would be more complex and therefore blow molding is preferred.

Turning now to FIG. 4, there is shown a bumper 11 made up of four bumper units 10 positioned end-to-end. An elongate, flexible connecting member in the form of a rope 24 passes through all the passage means in the units 10. A knot 40 is tied at one end of the rope to prevent this end from sliding through the passage means in the bumper unit that is furthest to the left in FIG. 4. At the other end of the bumper is a means to fix the bumper units against displacement relative to the connecting member 24. Preferably the fixing means comprises a cleat adapted for attachment to the rope 24 adjacent the bumper unit located at the right hand end of the bumper. The cleat 42 can comprise any of a number of well known rope cleats. The illustrated rope cleat is Loop Cleat CL223 sold under the trade mark Clamcleat. This particular rope cleat is suitable for holding rope or line $\frac{1}{8}$ to $\frac{1}{4}$ inch in diameter. It has two opposed rows of teeth for gripping the sides of the rope.

Figure 5:
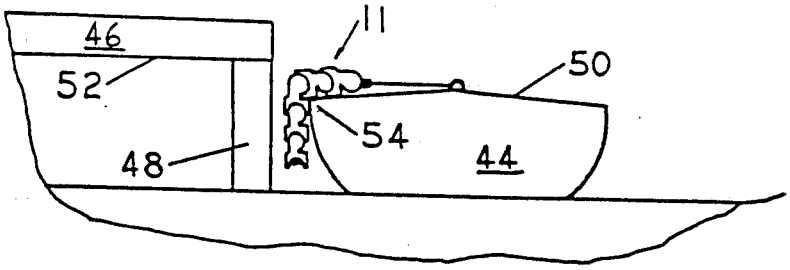
FIG. 5 is an illustration showing how a bumper constructed in accordance with the invention can bend around a sharp corner on a boat.

FIG. 5 shows how the bumper of the present invention bends around a sharp corner to fully protect a boat 44. The illustrated boat is tied to a dock 46 by ropes (not shown). The dock 46 is supported on piles or posts 48 that can be spaced apart a considerable distance. Because the boat 44 is lying low in the water, its top deck 50 lies below the bottom surface 52 of the deck of the dock. It will be readily appreciated that under these circumstances the top deck 50 of the boat could be damaged if the boat is driven under the dock and between the piles 48 by waves or by the current. When the boat is in this position, waves can lift the boat and shove the top deck 50 against the bottom surface 52 of the dock. A suitable bumper 11 constructed in accordance with the invention will prevent damage both to the top deck of the boat and to the side of the hull. In addition the 90 degree corner located at 54 between the top deck and the hull is fully protected. If the bumper units that form the bumper 11 are held closely together by a knot at one end and a cleat at the other end, the units will not separate even when the bumper is bent 90 degrees as shown.

If the bumper unit is hollow, it can be filled with gas under pressure in order that it will retain its shape and have the necessary strength to act as a bumper. Preferably this gas under pressure is injected during the molding process and permanently sealed in the bumper unit. However it would be possible to provide a needle-type inflating valve on an exposed surface of each bumper unit so that the unit can be pneumatically inflated in a conventional manner. Such a valve might be provided on the flat side 56 of each unit.

The size of each bumper unit can vary depending upon the intended use for the unit. Smaller units could be used to construct a bumper suitable for small boats while larger units would be used for large boats and yachts.

It will be appreciated that various modifications to the bumper unit and bumper of this invention can be made without departing from the spirit and scope of this invention as defined by the appended claims.

What is claimed is:

1. A bumper unit for protecting the hull of a boat comprising a one-piece bumper body of resilient, deformable non-metallic material, said body having a curved male portion and a socket portion, each of which has a width at least substantially equal to its length extending in the longitudinal direction of the unit, said male portion having a peripheral surface forming a partial cylinder extending through an arc of at least 270 degrees but less than 360 degrees, said peripheral surface extending to a point near the middle of an adjacent end of said socket portion, said socket portion having a semi-cylindrical cavity with a radius substantially equal to the radius of said partial cylinder, said cavity being open on two opposite sides of the unit and located a short distance from the male portion relative to the length of the unit, said socket portion having four flat exterior sides extending in the longitudinal direction of the unit, and passage means extending lengthwise of said body and including a narrow bore portion extending through the transverse center of said socket portion and partway through said male portion and a wide slot portion in a section of the male portion furthest from said socket portion, said slot portion opening into said partial cylinder across an arc of at least 90 degrees, wherein said passage means is adapted for passage of a rope to connect said unit to a similar bumper unit.

2. A bumper for protecting the hull of a boat comprising a plurality of one-piece bumper bodies of resilient deformable non-metallic material positioned end-to-end, each of said bodies having a curved male portion and a socket portion, each of which has a width at least substantially equal to its length extending in the longitudinal direction of the unit, said male portion having a peripheral surface forming a partial cylinder extending through an arc of at least 270 degrees but less than 360 degrees, said peripheral surface to a point near the middle of an adjacent end of said socket portion, said socket portion having a semi-cylindrical cavity with a radius substantially equal to the radius of said partial cylinder, said cavity being located a short distance from the curved male portion relative to the length of each unit and being open on two opposite sides of the unit, said socket portion having four flat exterior sides extending in the longitudinal direction of the unit, each body having passage means extending lengthwise of said body and including a narrow bore portion extending through the transverse center of said socket portion and partway through said male portion and a wide slot portion in a section of the male portion furthest from said socket portion, said slot portion opening into said partial cylinder across an arc of at least 90 degrees, and a rope passing through all said passage means, said bodies positioned on said rope with said male portion positioned in the socket portion of the adjoining bumper body.

* * * * *